US007757652B2

(12) United States Patent
Miyamoto et al.

(10) Patent No.: US 7,757,652 B2
(45) **Date of Patent: *Jul. 20, 2010**

(54) COMPONENT FOR INSERT CASTING, CYLINDER BLOCK, AND METHOD FOR MANUFACTURING CYLINDER LINER

(75) Inventors: Noritaka Miyamoto, Toyota (JP); Masaki Hirano, Toyota (JP); Toshihiro Takami, Toyota (JP); Kouhei Shibata, Toyota (JP); Nobuyuki Yamashita, Shiojiri (JP); Toshihiro Mihara, Matsumoto (JP); Giichiro Saito, Yamagata (JP); Masami Horigome, Yamagata (JP); Takashi Sato, Yamagata (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 748 days.

This patent is subject to a terminal disclaimer.

(21) Appl. No.: 11/481,084

(22) Filed: Jul. 6, 2006

(65) Prior Publication Data

US 2007/0012180 A1 Jan. 18, 2007

(30) Foreign Application Priority Data

Jul. 8, 2005 (JP) ..... 2005-201004

(51) Int. Cl.
*F02F 1/00* (2006.01)
*B22D 19/00* (2006.01)

(52) U.S. Cl. ..... 123/193.2

(58) Field of Classification Search ..... 123/668, 123/669, 193.2; 29/888.061; 92/171.1
See application file for complete search history.

(56) References Cited

U.S. PATENT DOCUMENTS 5,829,405 A * 11/1998 Godel ..... 123/193.2
6,095,126 A * 8/2000 Kloft et al. ..... 123/668
7,073,492 B2 * 7/2006 Hoffmann et al. ..... 123/669

(Continued)

FOREIGN PATENT DOCUMENTS

DE 197 29 017 A1 2/1999

(Continued)

OTHER PUBLICATIONS

International Search Report, PCT/JP2006/313913 dated Oct. 25, 2006.

(Continued)

*Primary Examiner*—Marguerite J. McMahon
(74) *Attorney, Agent, or Firm*—Kenyon & Kenyon LLP

(57) ABSTRACT

A cylinder liner 2 is enveloped in a cylinder block through insert casting. The cylinder liner 2 includes a cylinder liner body 2*a* and a metal coating layer 8 formed on the body 2*a* through a cold spraying method. Since the metal coating layer 8 is formed in a non-molten and oxygen free state, few oxygen films or oxygen layers are formed on the surface of or in the interior of the metal coating layer 8. Thus, the thermal conductivity of the metal coating layer 8 is sufficiently high. As a result, the thermal conductivity from the metal coating layer 8 to the cylinder block is sufficiently high.

19 Claims, 11 Drawing Sheets

U.S. PATENT DOCUMENTS

| | | | | |
|---|---|---|---|---|
| 2007/0009669 | A1* | 1/2007 | Miyamoto et al. | 427/446 |
| 2007/0012175 | A1* | 1/2007 | Miyamoto et al. | 92/171.1 |
| 2007/0012176 | A1* | 1/2007 | Takami et al. | 92/171.1 |
| 2007/0012177 | A1* | 1/2007 | Miyamoto et al. | 92/171.1 |
| 2007/0012178 | A1* | 1/2007 | Takami et al. | 92/171.1 |
| 2007/0012179 | A1* | 1/2007 | Takami et al. | 92/171.1 |
| 2007/0240652 | A1* | 10/2007 | Michioka et al. | 123/41.84 |

FOREIGN PATENT DOCUMENTS

| | | | |
|---|---|---|---|
| DE | 199 37 934 | A1 | 2/2001 |
| DE | 100 02 440 | A1 | 8/2001 |
| DE | 100 19 793 | C1 | 8/2001 |
| EP | 1 504 833 | A1 | 2/2005 |
| JP | 53-163405 | | 12/1978 |
| JP | 61-169153 | | 7/1986 |
| JP | 01-287236 | | 11/1989 |
| JP | 2832032 | | 9/1998 |
| JP | 2003-053508 | | 2/2003 |
| JP | 2003-120414 | | 4/2003 |
| WO | WO 01/58621 | A1 | 8/2001 |
| WO | WO 2005/038073 | A2 | 4/2005 |

OTHER PUBLICATIONS

Written Opinion of the International Searching Authority, PCT/JP2006/313913.

International Preliminary Report on Patentability, PCT/JP2006/313913.

* cited by examiner 2
8
2c
2a
6

Procedure for Manufacturing Cylinder Liner

Procedure for Manufacturing
Cylinder Liner

[ Process for Forming Hole having Constricted Shape ]

Contour Diagram

First Contour Diagram

Second Contour Diagram

COMPONENT FOR INSERT CASTING, CYLINDER BLOCK, AND METHOD FOR MANUFACTURING CYLINDER LINER

BACKGROUND OF INVENTION

The present invention relates to a component for insert casting, which is enveloped in a casting metal through insert casting, and a cylinder block having such an insert casting component as a cylinder liner.

Components for insert casting include, for example, cylinder liners, which are integrated with a cylinder block through insert casting to form cylinder bores. To maintain a high level of roundness of a cylinder bore, the outer circumferential surface of such a component, which contacts the casting material used in insert casting, needs to have a great bond strength with the cylinder block.

To produce such a great bond strength, it is important to adjust the state of the cylinder liner outer circumferential surface. Accordingly, a technique has been proposed in which a sprayed layer covers a cylinder liner outer circumferential surface to form a surface layer (for example, Japanese Laid-Open Utility Model Publication No. 53-163405). Japanese Laid-Open Utility Model Publication No. 53-163405 discloses a surface layer on a cylinder liner outer circumferential surface onto which granulated metal is sprayed such that the granulated metal irregularly collects on the surface and forms asperities. During casting, molten metal flows into the recesses of the asperities to produce anchor effect, and a great bond strength is produced.

Further, there has been proposed a technique in which a film of a low melting point material is metallurgically bonded to a cylinder liner outer circumferential surface by shot peening process or plasma spraying, so that no oxide film is formed on the surface (for example, Japanese Laid-Open Patent Publication No. 2003-53508). This increases the adhesion between the cylinder liner and a cylinder block.

Another technique has been proposed in which an activation layer made of an aluminum alloy is formed as a surface layer in a top dead center region and a bottom dead center region of a cylinder liner outer circumferential surface, so that the activation layer establishes metallic bonding with a crankcase (for example, Japanese Laid Open Patent Publication No. 2003-120414).

With the recent trend of reducing the weight of internal combustion engines, designs of engines with short distances between the cylinder bores have been adopted. Also, there is trend for increasing the power of engines. Accordingly, in a cylinder block produced through insert casing of a cylinder liner, there is a demand for improving the adhesion between the cylinder liner and the cylinder block, thereby improving the cooling performance.

However, in Japanese Laid-Open Utility Model Publication No. 53-163405 and Japanese Laid Open Patent Publication No. 2003-120414, the sprayed layer on the cylinder liner outer circumferential surface is formed by causing metal particles, which have been melted at a high temperature, to collide with the cylinder liner. Therefore, an oxide film is formed on the surface of the sprayed layer, and oxides exist in the sprayed layer. As a result, the thermal conductivity of the metal after the spraying process becomes less than that of the same metal before the process. This configuration does not improve the cooling performance to a satisfactory level.

According to Japanese Laid-Open Patent Publication No. 2003-53508, a film of a low melting point material is formed on a cylinder liner outer circumferential surface. When the film contacts molten metal during casting, thermal effect causes fusion, so that a favorable metallic bonding is produced. However, as in Japanese Laid-Open Utility Model Publication No. 53-163405 and Japanese Laid Open Patent Publication No. 2003-120414, the film is formed in a high temperature molten state such as spraying. Thus, formation of oxide film on the surface and formation of oxide layers in the film are inevitable. Therefore, this configuration does not guarantee a satisfactory level of cooling performance. In Japanese Laid-open Patent Publication No. 2003-53508, shot peening is used. However, shot peening is a surface treatment method and cannot form a complete film.

SUMMARY OF THE INVENTION

Accordingly, it is an objective of the present invention to produce, in a component for insert casting such as a cylinder liner the outer circumferential surface of which is enveloped by casting metal, a high thermal conductivity between the enveloping metal and a metal layer formed on the outer circumferential surface when the casting is completed.

According to a first aspect of the present invention, a component for insert casting having an outer circumferential surface that is enveloped in a casting metal through insert casting is provided. A metal coating layer is formed on the outer circumferential surface through a cold spraying method.

According to a second aspect of the present invention, a cylinder liner bonded to a cylinder block of an internal combustion engine is provided. The cylinder liner includes a cylinder liner body and a metal coating layer. The cylinder liner body has an outer circumferential surface that is enveloped, through insert casting, in a casting metal for forming the cylinder block. The metal coating layer is formed on the outer circumferential surface through a cold spraying method.

According to a third aspect of the present invention, a cylinder block of an internal combustion engine is provided. The cylinder block is formed by casting a metal. A cylinder liner is enveloped in the metal through insert casting so that the cylinder liner is bonded to the cylinder block. An outer circumferential surface of the cylinder liner, which is bonded to the cylinder block, has a metal coating layer formed through a cold spraying method.

According to a fourth aspect of the present invention, a method for manufacturing a cylinder liner that is, through insert casting, enveloped in a block material forming a cylinder block of an internal combustion engine is provided. The method includes: preparing a cylindrical cylinder liner body; and forming a metal coating layer on an outer circumferential surface of the cylinder liner body through a cold spraying method.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

First Embodiment

Figures 1A, 1B:
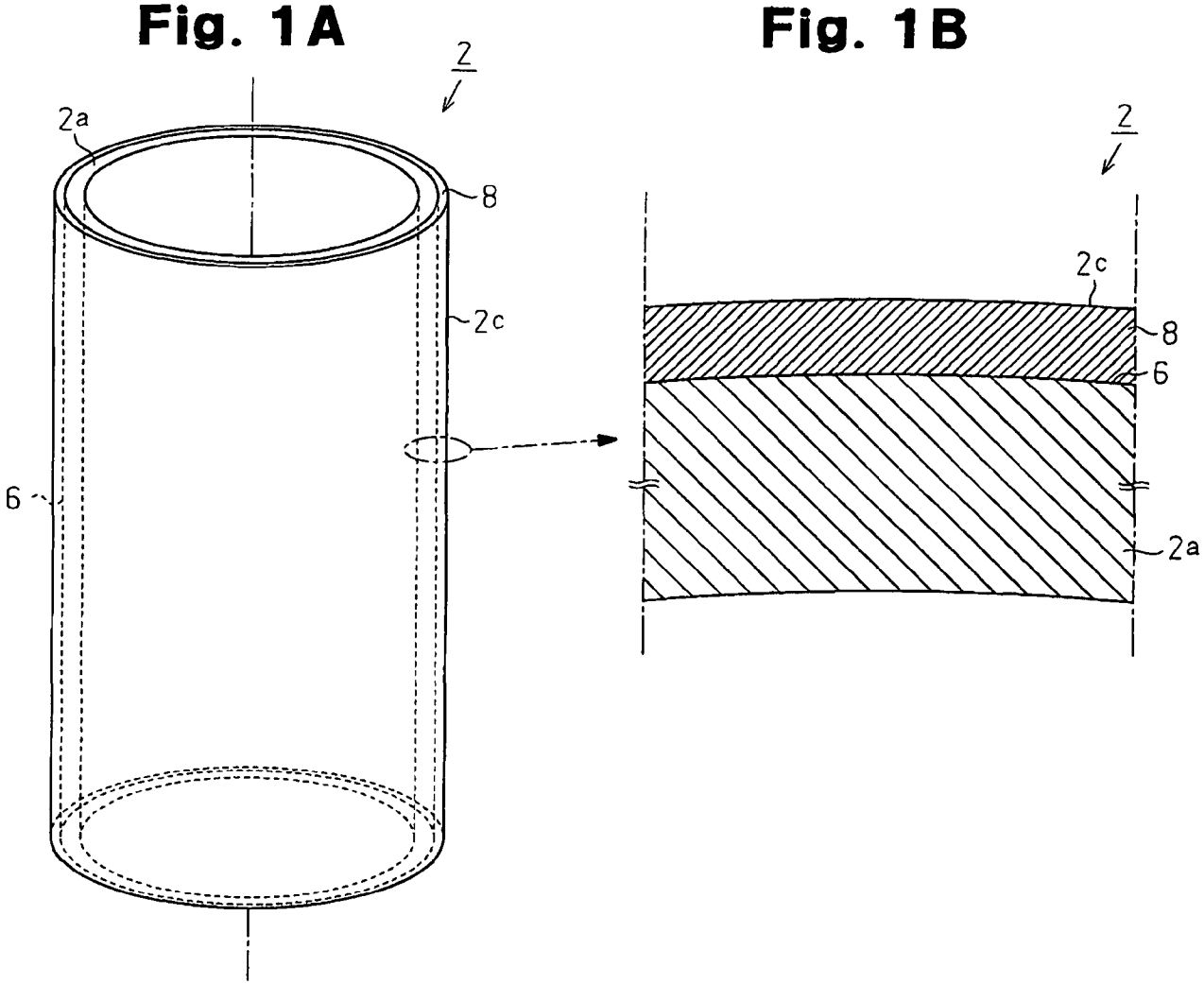
FIG. 1A is a diagrammatic view showing a cylinder liner according to a first embodiment.
FIG. 1B is a diagrammatic view showing a cylinder liner according to a first embodiment.
Figure 2B:
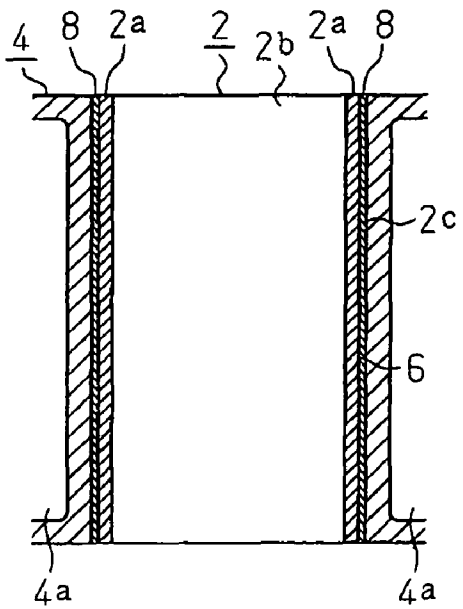
FIG. 2B is a diagrammatic view showing a cylinder block according to the first embodiment.
Figure 2A:
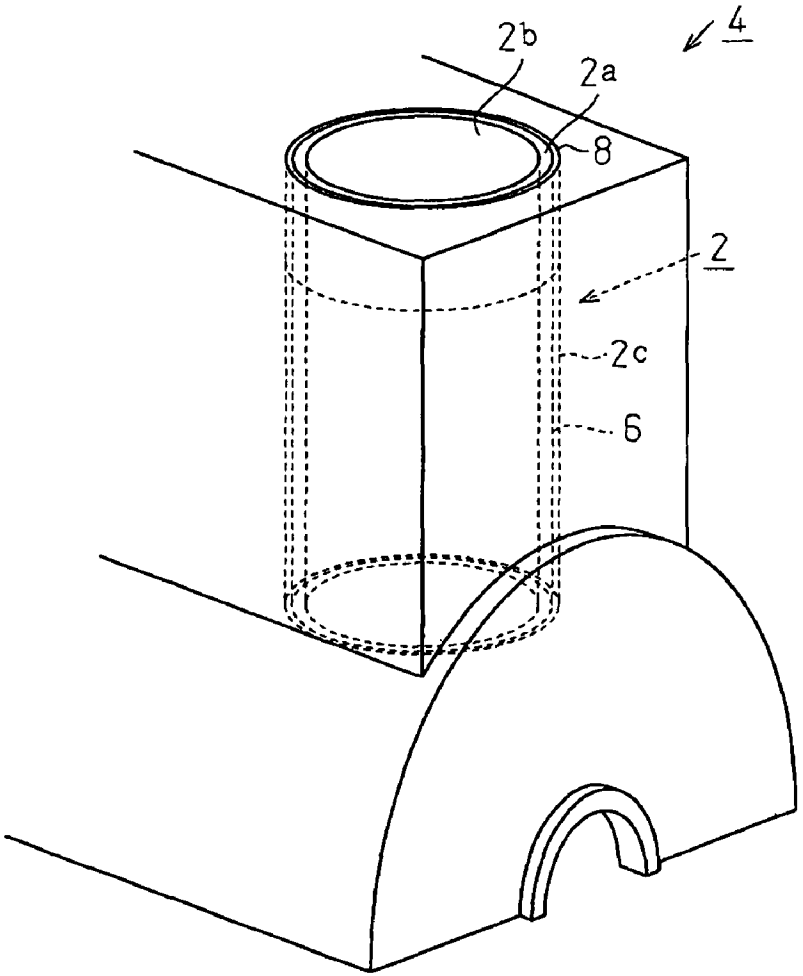
FIG. 2A is a diagrammatic view showing a cylinder block according to the first embodiment.

A first embodiment is shown in FIGS. 1A, 1B, 2A, and 2B. FIG. 1A is a perspective view a cylinder liner 2 according to the present invention. FIG. 1B is a partially enlarged cross-sectional view of the cylinder liner 2. FIG. 2A is a partially perspective view of a cylinder block 4 in which the cylinder liner 2 is enveloped through insert casting. FIG. 2B is a partially enlarged cross-sectional view of the cylinder block 4. A water jacket 4*a* is formed about the cylinder liner 2, which is enveloped in the cylinder block 4.

<Structure of Cylinder Liner 2>

A body 2*a* of the cylinder liner 2 shown in FIGS. 1A and 1B is a cylindrical body made of cast iron. The cylinder liner 2 is formed by forming a metal coating layer 8 on an outer circumferential surface 6 of the cylinder liner body 2*a* (hereafter referred to as outer circumferential surface). The metal coating layer 8 metallurgically bonds the cylinder liner 2 with the cylinder block 4 during casting.

Taking the wear resistance, the seizure resistance, and the formability into consideration, the composition of the iron cast is preferably set as follows.

T.C: 2.9 to 3.7% by mass
Si: 1.6 to 2.8% by mass
Mn: 0.5 to 1.0% by mass
P: 0.05 to 0.4% by mass
The following substances may be added as necessary.
Cr: 0.05 to 0.4% by mass
B: 0.03 to 0.08% by mass
Cu: 0.3 to 0.5% by mass <Composition of Metal Coating Layer 8>

A highly thermal conductive metal material is used as the metal material for forming the metal coating layer 8. For example, aluminum, an aluminum alloy, copper, or a copper alloy may be used.

<Formation of Metal Coating Layer 8>

When forming the metal coating layer 8 on the outer circumferential surface 6, the outer circumferential surface 6 is roughened in advance by a roughening device (in this embodiment, a blasting device or a water jet device).

After the outer circumferential surface 6 is roughened, solid phased and pulverized high thermal conductive metal material is caused to collide with the surface 6 in a supersonic flow with inert gas using a cold spray apparatus. Accordingly, the particles of the higher thermal conductive metal material plastically deformed on the outer circumferential surface 6 and form the metal coating layer 8.

As long as the casting material for casting the cylinder block 4, or block material, is aluminum or an aluminum alloy, the same material as the block material may be pulverized and used for the cold spraying.

<Structure And Casting of Cylinder Block 4>

As shown in FIGS. 2A and 2B, the cylinder block 4 is formed by enveloping the cylinder liner 2 through insert casting. Specifically, an outer circumferential surface 2*c* of the cylinder liner 2, on which the metal coating layer 8 is formed, is enveloped by the block material. A light alloy is used as the casting material used as the block material. Taking reduction of weight and costs into consideration, aluminum or an aluminum alloy is used as the block material. As the aluminum alloy, for example, an alloy specified in Japanese Industrial Standard (JIS) ADC10 (related United States standard, ASTM A380.0) or an alloy specified in JIS ADC12 (related United States standard, ASTM A383.0) may be used.

The cylinder liner 2 shown in FIG. 1A is placed in a mold. Then, molten aluminum or aluminum alloy is poured into the mold. The cylinder block 4 is produced in which the entire outer circumference of the metal coating layer 8 is enveloped in aluminum or an aluminum alloy.

Figure 3:
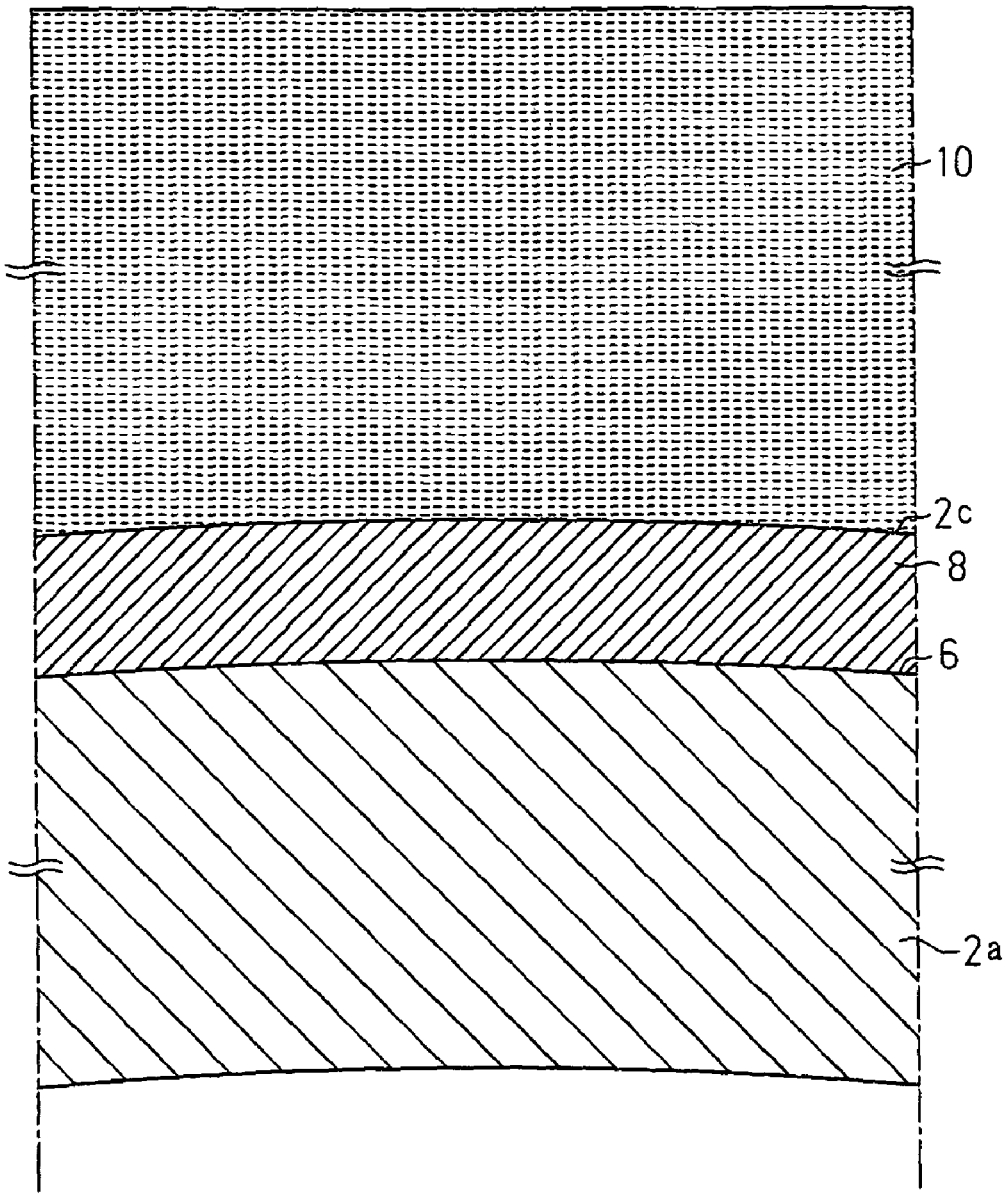
FIG. 3 is a diagrammatic view showing the cylinder block according to the first embodiment during casting.

As shown in FIG. 3, during casting, molten metal 10 contacts and heats the metal coating layer 8 on the outer circumferential surface 6. Since the metal coating layer 8 is formed through cold spraying as described above, few oxide layers exist on the surface of the metal coating layer 8, that is, on the outer circumferential surface 2*c* of the cylinder liner 2, and the molten metal 10 is solidified while sufficiently adhering to the metal coating layer 8. The casting of the cylinder block 4 is thus completed.

The first embodiment described above has the following advantages.

(i) The metal coating layer 8 is formed by cold spraying. When casting the cylinder block 4, the molten metal 10 contacts the metal coating layer 8 and is solidified. In the cold spraying, the metal coating layer 8 is formed on the cylinder liner body 2*a* in a non-molten and oxygen free state as described above. Thus, few oxygen films or oxygen layers are formed on the surface of or in the interior of the formed metal coating layer 8.

Therefore, when the cylinder liner 2 is enveloped in the block material through insert casting, the cylinder block 4 is formed with a high adhesion between the outer circumferential surface 2*c*, which is the surface of the metal coating layer 8, and the block material. Therefore, the thermal conductivity from the boundary of the metal coating layer 8 to the cylinder block 4 is increased. Further, since few oxide layers exist in the metal coating layer 8, the metal coating layer 8 itself has a high thermal conductivity.

Therefore, the thermal conductivity from the metal coating layer 8 to the cylinder block 4 is sufficiently high.

Accordingly, the thermal conductivity from the cylinder liner 2 to the cylinder block 4 is sufficiently increased, so that cooling of the cylinder bore 2*b* is satisfactorily performed by the water jacket 4*a*.

(ii) As described above, the material for the metal coating layer 8 is a high thermal conductivity metal material. The metal coating layer 8 contains in it few oxide layers as described above, and exerts a sufficient thermal conductivity as the material. Advantage (i) is thus further remarkable.

Second Embodiment

<Structure of Cylinder Liner 12>

Figure 4:
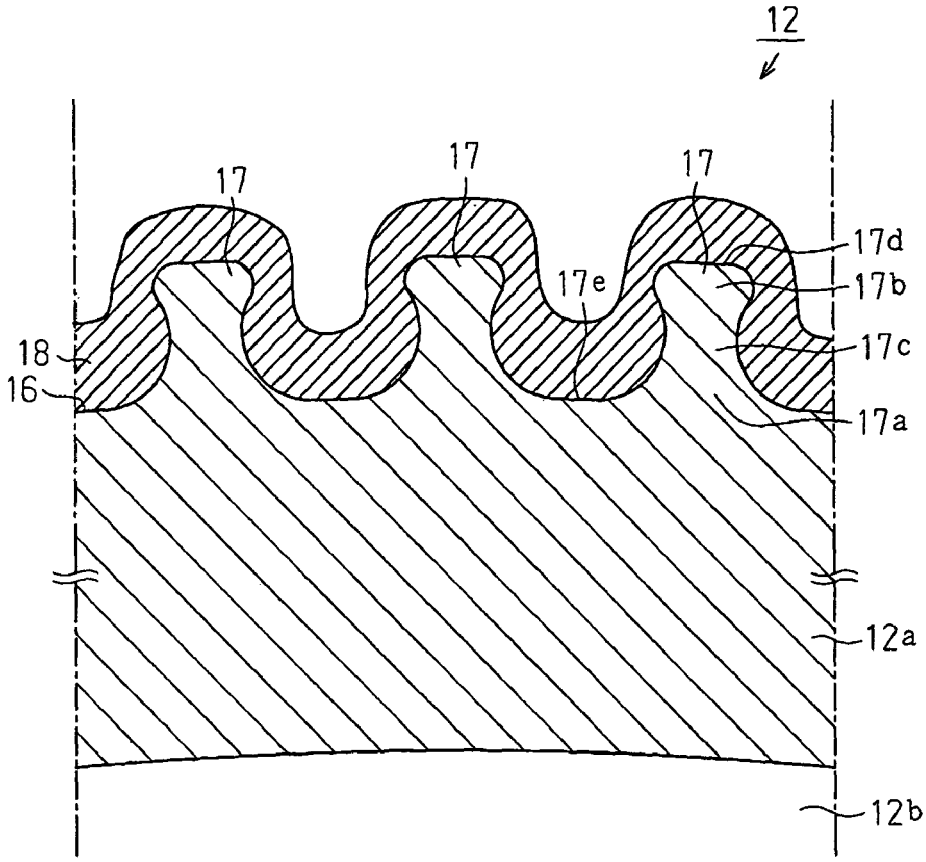
FIG. 4 is a diagrammatic view showing a cylinder liner according to a second embodiment.

FIG. 4 is a partially cross-sectional view of a cylinder liner according to a second embodiment. Although a body 12*a* of the cylinder liner 12 is made of cast iron having the same composition as that of the first embodiment, a plurality of projections 17 each having a constricted shape are integrally formed on an outer circumferential surface 16. Each projection 17 is formed in the following manner.

(1) Each projection 17 has the narrowest section (constriction 17*c*) in middle portion between a proximal end 17*a* and a distal end 17*b*.

(2) Each projection 17 is flared from the constriction 17*c* toward the proximal end 17*a* and toward the distal end 17*b*.

(3) Each projection 17 has a substantially flat top surface 17*d* at the distal end 17*b*. The top surface 17*d* is the outermost surface in the radial direction of the cylinder liner body 12*a*.

(4) A substantially flat surface (base surface 17*e*) is formed between the projections 17.

After the outer circumferential surface 16 is roughened, a metal coating layer 18 is formed on the outer circumferential surface 16. The metal coating layer 18 metallurgically bonds with a block material. The metal coating layer 18 is the same as the metal coating layer of the first embodiment. That is, a highly thermal conductive metal material is used as the metal material for forming the metal coating layer 18. For example, aluminum, an aluminum alloy, copper, or a copper alloy may be used.

<Process For Producing Cylinder Liner 12>

Figure 5:
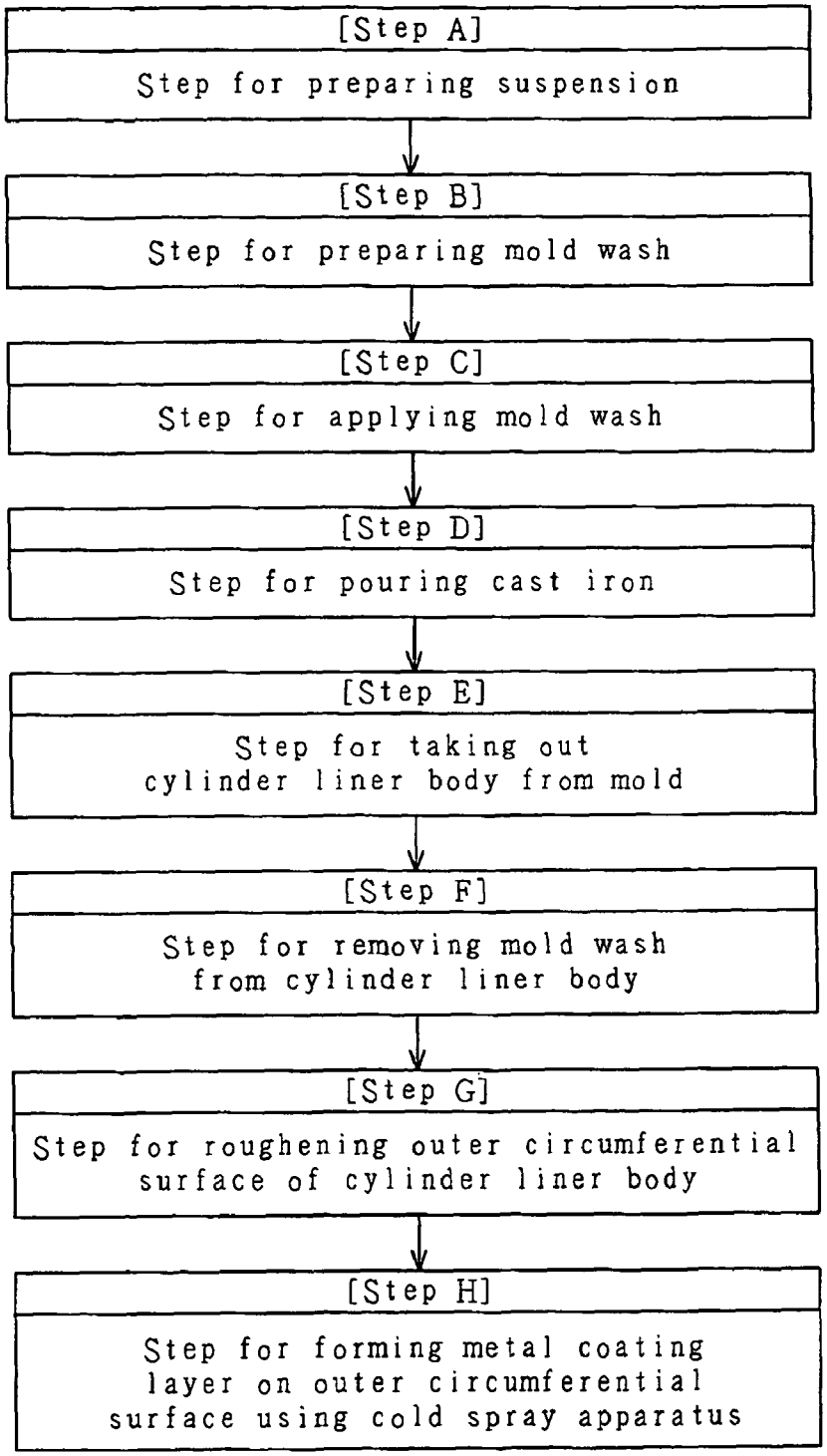
FIG. 5 is a diagram showing a procedure for manufacturing the cylinder liner according to the second embodiment.

The production of the cylinder liner 12 is executed according to the procedure of [step A] to [step H] shown in FIG. 5.

Figure 6:
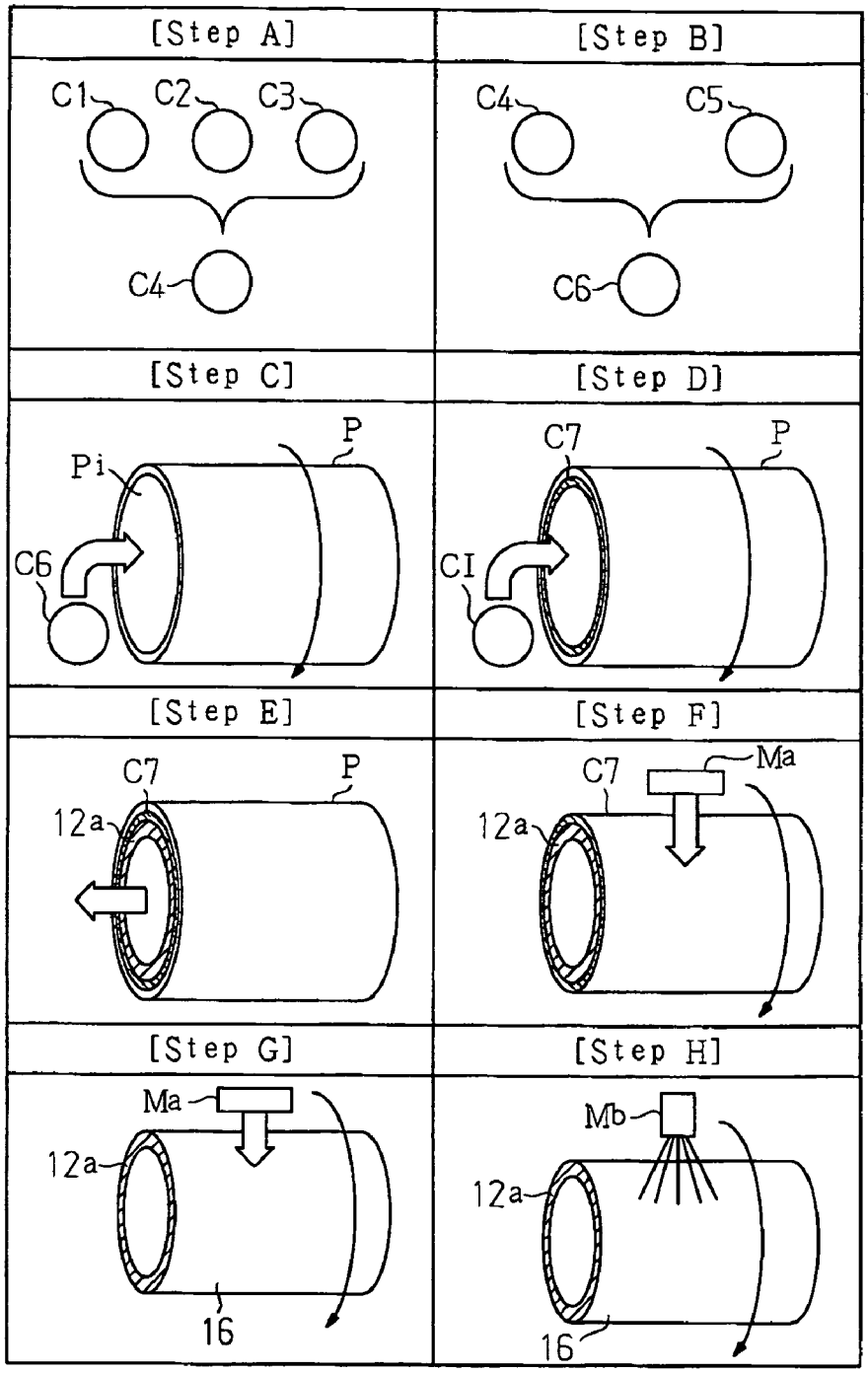
FIG. 6 is a process diagram showing steps for producing the cylinder liner according to the second embodiment.

Each step will be described with reference to a process diagram FIG. 6.

[Step A]

Suspension C4 is prepared by compounding refractory material C1, binder C2, and water C3 in predetermined ratios.

In this embodiment, possible ranges for the loadings of the refractory material C1, the binder C2, and water C3 and possible ranges for the average particle size of the refractory material C1 are set as follows.

Loading of the refractory material C1: 8 to 30% by mass

Loading of the binder C2: 2 to 10% by mass

Loading of water C3: 60 to 90% by mass

Average particle size of the refractory material C1: 0.02 to 0.1 mm

[Step B]

A predetermined amount of surfactant C5 is added to the suspension C4 to obtain mold wash C6.

In this embodiment, a possible range of the loading of the surfactant C5 is set as follows.

Loading of the surfactant C5: 0.005% by mass $<X \leqq 0.1\%$ by mass (X represents the loading)

[Step C]

The mold wash C6 is applied through spraying on an inner circumferential surface Pi of a mold P, which has been heated to a prescribed temperature and is being rotated. At this time, the mold wash C6 is applied such that a layer of the mold wash C6 (mold wash layer C7) of a uniform thickness is formed on the entire inner circumferential surface Pi.

In this embodiment, a possible range for the thickness of the mold wash layer C7 is set as follows.

Thickness of the mold wash layer C7: 0.5 to 1.5 mm

Figure 7:
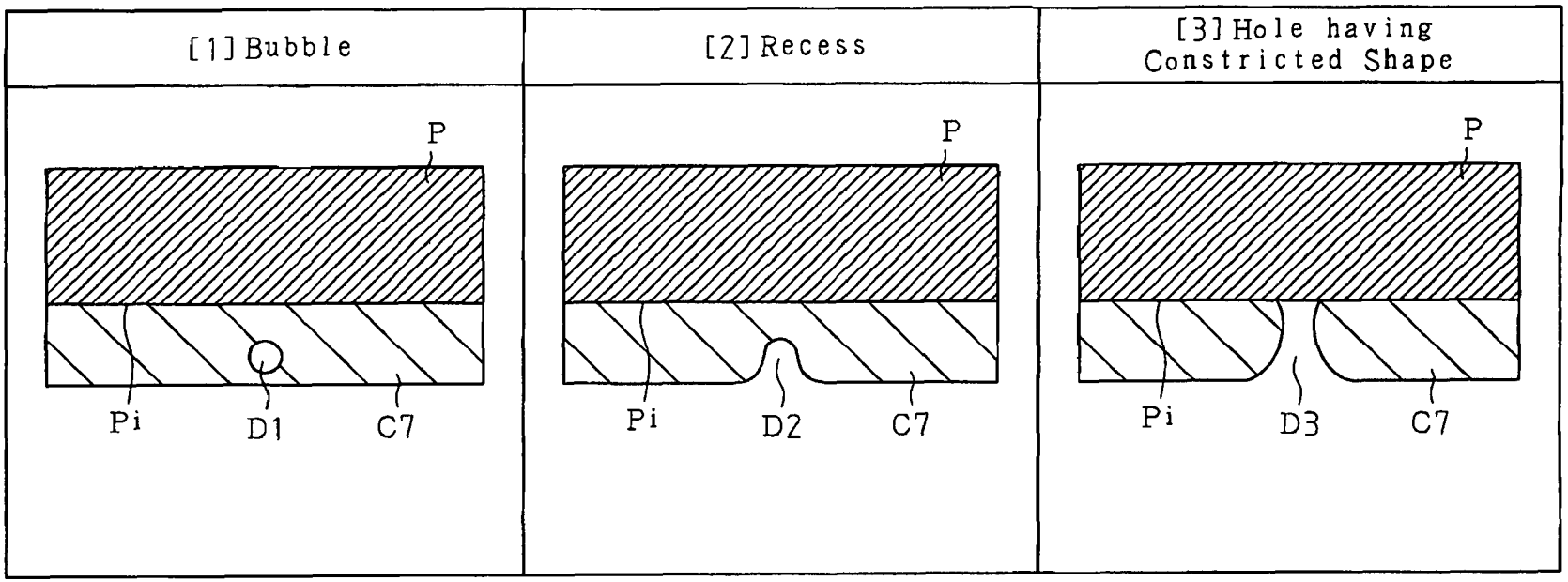
FIG. 7 is a process diagram showing steps for forming a recess having a constricted shape in a casting mold according to the second embodiment.
Figure 8:
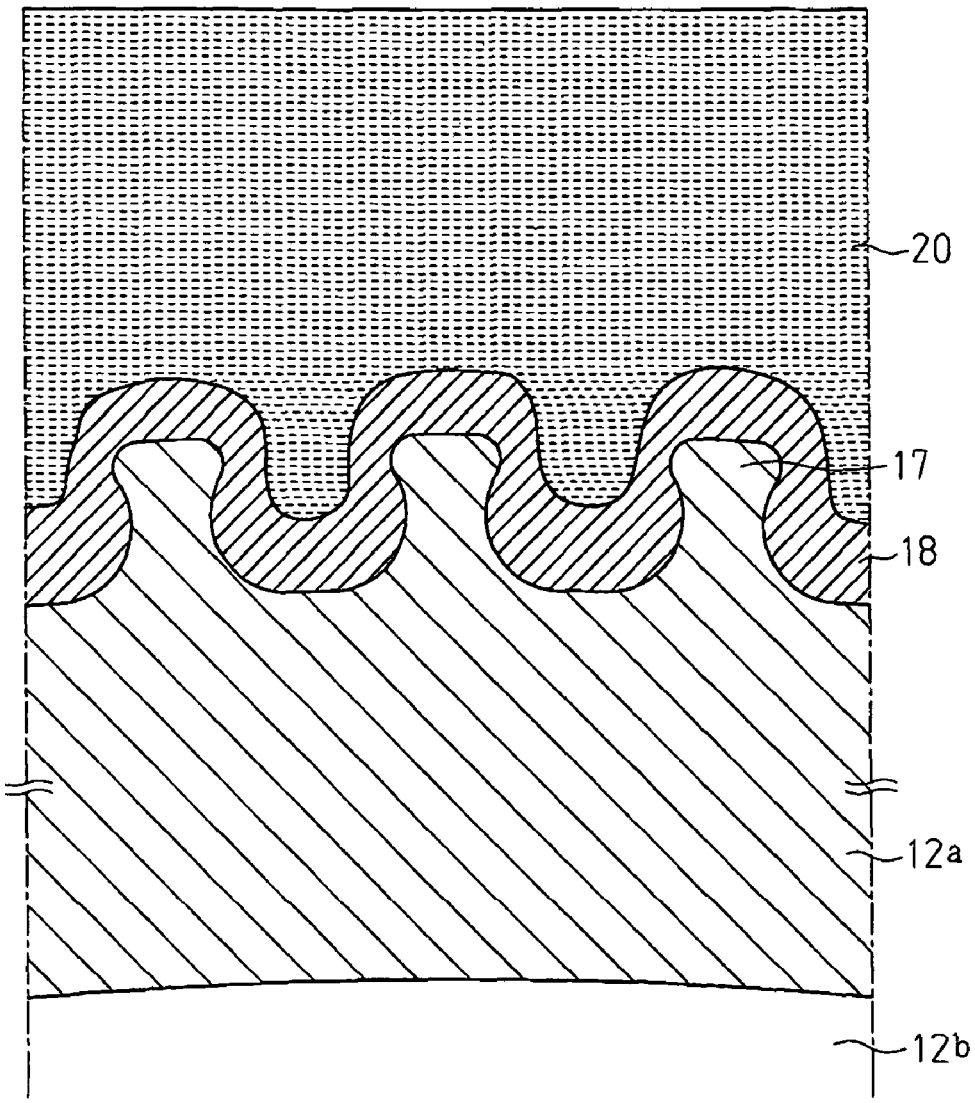
FIG. 8 is a diagrammatic view showing the cylinder block according to the second embodiment during casting.
Figure 9:
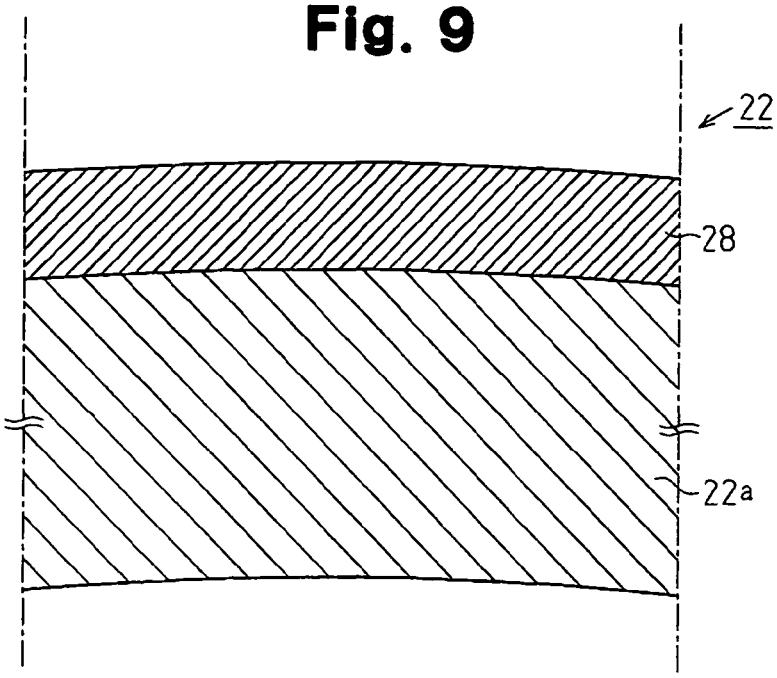
FIG. 9 is a diagrammatic view showing a cylinder liner according to a third embodiment.

FIG. 7 shows one example of the order of steps for forming a hole with a constriction in the mold wash layer C7.

As shown in FIG. 7, the surfactant C5 acts on a bubble D1 in the mold wash layer C7, so that a recess D2 is formed to extend toward the inner circumference of the mold wash layer C7. The recess D2 reaches the inner circumferential surface Pi of the mold P, so that a hole D3 having a constricted shape is formed in the mold wash layer C7.

[Step D]

After the mold wash layer C7 is dried, molten metal C1 of cast iron is poured into the mold P, which is being rotated. Accordingly, the cylinder liner body 12*a* is cast. At this time, projections each having a shape that corresponds to the shape of the hole D3 of the mold wash layer C7 are transferred onto the cylinder liner body 12*a* so that the projections 17 (see FIG. 4) each having a constriction are formed on the outer circumferential surface 16.

[Step E]

After the molten metal C1 is hardened and the cylinder liner body 12*a* is formed, the cylinder liner body 12*a* is taken out of the mold P with the mold wash layer C7.

[Step F]

Using a blasting device Ma, the mold wash C7 is removed from the outer circumferential surface 16.

[Step G]

Using a roughening device (a blasting device such as the blasting device Ma or a waterjet device), the outer circumferential surface 16 is roughened.

[Step H]

Using a cold spray device Mb, the outer circumferential surface 16 is coated with powder of a high thermal conductive metal material as in the first embodiment. This forms the metal coating layer 18 on the outer circumferential surface 16 to cover the projections 17.

The cylinder liner 12 shown in FIG. 4 is thus completed.

<Area Ratio of Projection 17>

In this embodiment, possible ranges for a first area ratio S1 and a second area ratio S2 of the projections 17 on the cylinder liner body 12*a* are set as follows.

First area ratio S1: no less than 10%

Second area ratio S2: no more than 55%

Alternatively, the following settings may be applied.

First area ratio S1: 10 to 50%

Second area ratio S2: 20 to 55%

The first area ratio S1 corresponds to the cross-sectional area of the projections 17 per unit area in a plane the height of which is 0.4 mm from the base surface 17*e* (the distance in the height direction with reference to the base surface 17*e*).

The second area ratio S2 corresponds to the cross-sectional area of the projections 17 per unit area in a plane the height of which is 0.2 mm from the base surface 17*e* (the distance in the height direction with reference to the base surface 17*e*).

The area ratios S1, S2 are obtained based on a contour diagrams (FIGS. 11 and 12, discussed below) of the projection 17 obtained by using a three-dimensional laser measuring device.

The height and the distribution density of the projection 17 are determined by the depth and the distribution density of the holes D3 of the mold wash layer C7 formed in step C. Specifically, the mold wash layer C7 is formed such that the height of the projections 17 is 0.5 mm to 1.5 mm, and the distribution density of the projections 17, or the number of the projections 17 per $cm^2$ of the outer circumferential surface, is five to sixty.

<Production of Cylinder Block>

The cylinder block is produced by placing the cylinder liner 12 shown in FIG. 4 in a mold, and pouring molten metal 20 of a block material into the mold so that the outer circumferential surface 16 is enveloped in the molten metal 20. The block material is the same as that described in the first embodiment 1, and the same light alloy is used.

In the cylinder block according to the second embodiment produced in the procedure in this manner, the molten metal 20 is solidified while sufficiently adhering to the metal coating layer 18 through the mechanism explained in the first embodiment.

The second embodiment has the following advantages.

(i) In addition to the advantages of the first embodiment, the metal coating layer 18 and the cylinder liner body 12*a* are bonded to each other not only by cold spraying but also by the projections 17 each having a constricted shape. Therefore, the bond strength between the cylinder liner body 12*a* and the metal coating layer 18, and the bond strength between the cylinder liner body 12*a* and the cylinder block with the metal coating layer 18, are further increased. Accordingly, a high level of roundness of the cylinder bore 12*b* is maintained Further, the projections 17 having a constricted shape further increase the thermal conductivity from the cylinder liner body 12*a* to the cylinder block, which improves the cooling performance of the cylinder bore 12*b*.

Third Embodiment

In a third embodiment, a cylinder liner body 22*a*, which is the same as the cylinder liner body of the first embodiment is used. A metal coating layer 28 is formed on the cylinder liner body 22*a* with a low melting point metal powder material by using a cold spraying apparatus, thereby producing a cylinder liner 22.

The low melting point metal material may be zinc, a zinc alloy, tin, a tin alloy, lead, a lead alloy, antimony, or an antimony alloy.

Like the metal coating layer of the first embodiment, the metal coating layer 28 formed by cold spraying contains few oxide films and oxide layers on the surface and in the interior.

Figure 10:
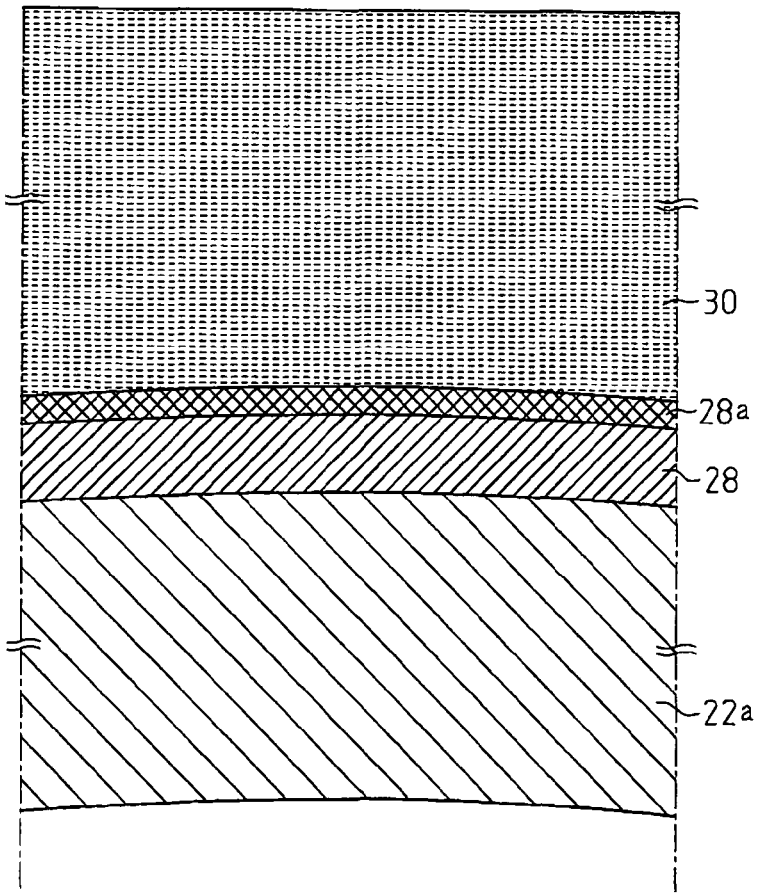
FIG. 10 is a diagrammatic view showing the cylinder block according to the third embodiment during casting.

As shown in FIG. 10, the cylinder liner 22 is enveloped in a molten metal 30 of a block material as in the first embodiment, thereby casting a cylinder block. During casting, since the metal coating layer 28 has a melting point lower than that of the block material (aluminum or an aluminum alloy) forming the molten metal 30, the molten metal 30 melts and is fused with the surface of the metal coating layer 28, so that a fused metal layer 28*a* is formed as shown in the drawings. The casting of the cylinder block is completed when the molten metal 30 and the molten metal layer 28*a* are solidified. At this time, the molten metal layer 28*a* is strongly bonded and adheres to the cylinder block and the metal coating layer 28.

The third embodiment has the following advantages.

(i) Since a low melting point metal material is used for the metal coating layer 28, the surface of the metal coating layer 28, on which few oxide films are formed, is melted when contacting the molten metal 30 and is fused with the molten metal 30. This increases the thermal conductivity between the metal coating layer 28 and the cylinder block after casting the metal coating layer 28, and the advantage (i) of the first embodiment is thus more remarkable.

(ii) Since the cold spraying does not melt metal, the use of a low melting point metal material does not cause clogging of the cold spray apparatus due to excessive melting. Thus, the workability of film forming is not degraded. Further, depending on the type of metal, sublimation is prevented. Thus, the efficiency of film forming is improved.

Fourth Embodiment

A cylinder liner according to a fourth embodiment has the same cylinder liner body 12*a* according to the second embodiment, which has the projections 17 formed on the outer circumferential surface 16. A metal coating layer according to the fourth embodiment is formed of a low melting point metal material like the metal coating layer 28 of the third embodiment.

The cylinder liner, which is formed by combining the cylinder liner body 12*a* of the second embodiment and the metal coating layer 28 of the third embodiment, is enveloped in a block material (aluminum or an aluminum alloy) through insert casting. The casting of the cylinder block is thus completed.

The fourth embodiment described above has the following advantages.

(i) The same advantages as the second and third embodiments are obtained.

[Description of Contour Lines of Projection]

The contour diagrams of the projections 17 of the second embodiment, which are obtained by using a three-dimensional laser measuring device, will now be described.

<Contour Diagram of Projection 17>

Figure 11A:
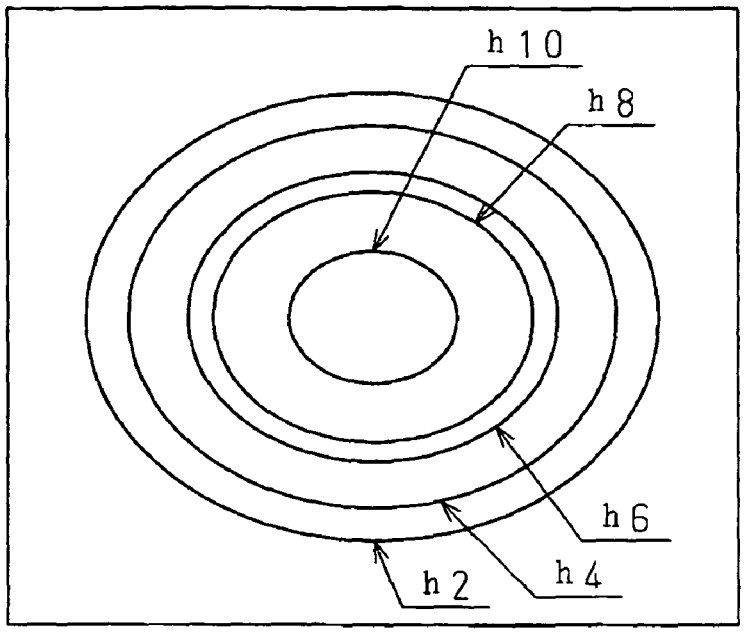
FIG. 11A is a diagram showing the shape of a projection formed on the liner outer circumferential surface according to the second embodiment or a fourth embodiment.
Figure 11B:
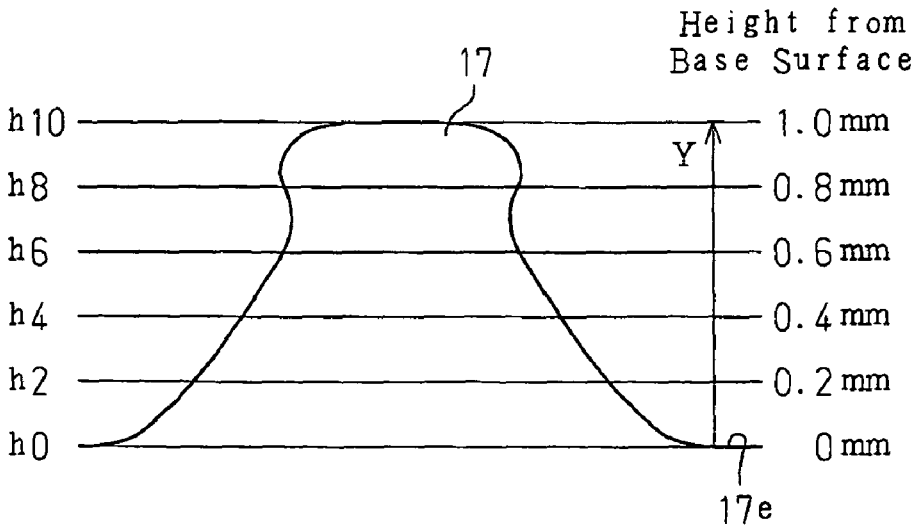
FIG. 11B is a diagram showing the shape of a projection formed on the liner outer circumferential surface according to the second embodiment or a fourth embodiment.

Referring to FIGS. 11A and 11B, the measurement of contour lines of the projection 17 of the second embodiment shown in FIG. 4 will now be described. When drawing up the contour diagram, a test piece for measuring contour lines is placed on a test bench such that the base surface 17*e* faces a noncontact three-dimensional laser measuring device. Measurement is executed by irradiating the base surface 17*e* with laser beam at an angle substantially perpendicular to the base surface 17*e*. The measurement results are sent to an image processing device to obtain a contour diagram of the projection 17 as shown in FIG. 11A.

FIG. 11B shows the relationship between the base surface 17*e* and contour lines h (h0 to h10). As illustrated, the contour lines h are displayed at a predetermined interval from the base surface 17*e* along the height of the projection 17 (direction of arrow Y). Hereinafter, the distance along arrow Y with reference to the base surface 17*e* will be referred to as measurement height.

Although FIGS. 11A and 11B show a diagram in which the contour lines h are shown at a 0.2 mm interval, the distance between the contour lines h may be changed as necessary.

[a] First Area Ratio S1 of Projection 17

Figure 12A:
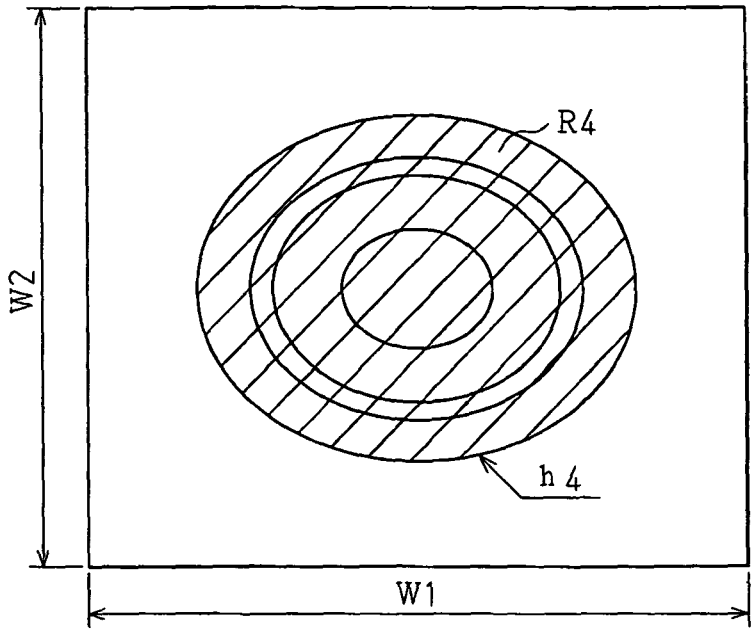
FIG. 12A is a diagram with contour lines showing the shape of a projection formed on the liner outer circumferential surface according to the second embodiment or the fourth embodiment.

FIG. 12A is a contour diagram in which contour lines h less than 0.4 mm of measurement height are not displayed (first contour diagram). The area of the contour diagram as shown (W1×W2) is a unit area for measuring the first area ratio S1.

In the first contour diagram, the area of a region R4 surrounded by the contour line h4 (the area of cross-hatched section SR4 in the drawing) corresponds to the cross-sectional area of a projection that lies in the plane of a measurement height of 0.4 mm (the first cross-sectional area of the projection 17). The number of the regions R4 in the first contour diagram (the number of regions N4) corresponds to the number of the projections 17 in the first contour diagram.

The first area ratio S1 is calculated as the ratio of the total area of the regions R4 (SR4×N4) to the area of the contour diagram (W1×W2). That is, the first area ratio S1 corresponds to the total area of the first cross-sectional area in the unit area in the plane of the measurement height of 0.4 mm. In a contour diagram of the projections, that is, in a contour diagram of the outer circumferential surface of the cylinder liner body, the first area ratio S1 is equal to the ratio of the total area of the first cross-sectional areas to the area of the entire contour diagram.

The first area ratio S1 is computed by the following equation.

$$S1=(SR4\times N4)/(W1\times W2)\times 100[\%]$$

[b] Second Area Ratio S2 of Projection 17

Figure 12B:
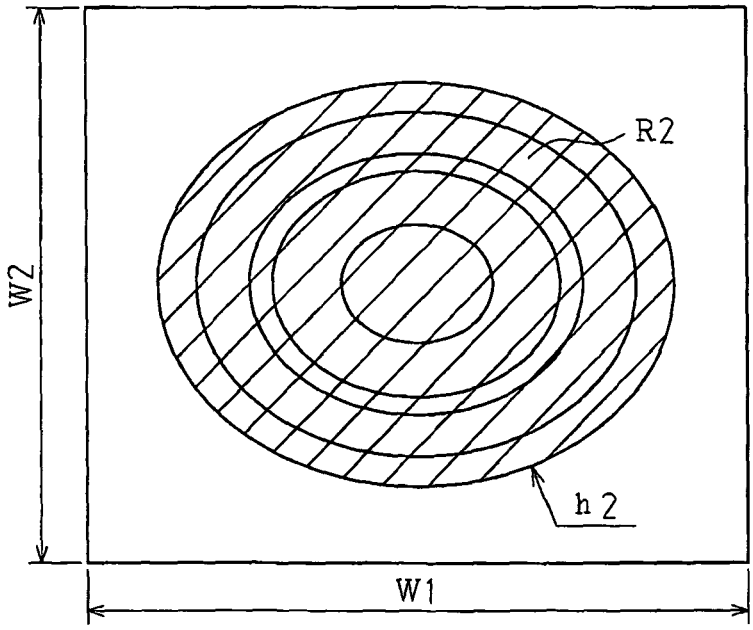
FIG. 12B is a diagram with contour lines showing the shape of a projection formed on the liner outer circumferential surface according to the second embodiment or the fourth embodiment.

FIG. 12B is a contour diagram in which contour lines h less than 0.2 mm of measurement height are not displayed (second contour diagram). The area of the contour diagram (W1×W2) is a unit area for measuring the second area ratio S2.

In the second contour diagram, the area of a region R2 surrounded by the contour line h2 (the area of cross-hatched section SR2 in the drawing) corresponds to the cross-sectional area of a projection that lies in the plane of a measurement height of 0.2 mm (the second cross-sectional area of the projection 17). The number of the regions R2 in the second contour diagram (the number of regions N2) corresponds to the number of the projections 17 in the second contour diagram. Since the area of the second contour diagram is equal to the area of the first contour diagram, the number of the projections 17 is equal to the number of projections N1.

The second area ratio S2 is calculated as the ratio of the total area of the regions R2 (SR2×N2) to the area of the contour diagram (W1×W2). That is, the second area ratio S2 corresponds to the total area of the second cross-sectional area in the unit area in the plane of the measurement height of 0.2 mm. In a contour diagram of the projections, that is, in a contour diagram of the outer circumferential surface of the cylinder liner body, the second area ratio S2 is equal to the ratio of the total area of the second cross-sectional areas to the area of the entire contour diagram.

The second area ratio S2 is computed by the following equation.

$$S2=(SR2\times N2)/(W1\times W2)\times 100[\%]$$

[c] First And Second Projection Cross-Sectional Areas

The first cross-sectional area of the projection 17 is calculated as a cross-sectional area of one projection that lies in a plane of the measurement height of 0.4 mm based on the contour diagrams. The second cross-sectional area of the projection 17 is calculated as a cross-sectional area of one projection that lies in a plane of the measurement height of 0.2 mm based on the contour diagrams. For example, through image processing of the contour diagrams, the first cross-sectional area of the projections 17 is obtained by calculating the area of the region R4 in the first contour diagram [FIG. 12A]. Also, through image processing of the contour diagrams, the second cross-sectional area of the projections 17 is obtained by calculating the area of the region R2 in the second contour diagram [FIG. 12B].

[d] Number of Projections

The number of projections N1 is calculated as the number of the projections 17 formed per unit area (1 $cm^2$) on the outer circumferential surface 16 of the cylinder liner based on the contour diagrams. For example, through image processing of the contour diagrams, the number of projections N1 is obtained by calculating the number of the regions R4 in the first contour diagram [FIG. 12A].

A cylinder liner of which the first area ratio S1 was no less than 10% and a cylinder liner of which the first area ratio S1 was less than 10% were applied to cylinder blocks, and deformation amount of these cylinder bore were compared. The deformation amount of the latter was confirmed to be more than three times that of the former.

When the second area ratio S2 is more than 55%, the voidage increases significantly. The voidage refers to a ratio of the area of voidage formed in the boundary between the cylinder liner and the cylinder block to the boundary cross-section.

From these results, it was confirmed that applying a cylinder liner of which the first area ratio S1 is no less than 10% and the second area ratio S2 is no more than 55% to a cylinder block favorably improves the bond strength and the adhesion between the block material and the cylinder liner.

By setting the upper limit of the first area ratio S1 to 50%, the second area ratio S2 is set to no more than 55%. By setting the lower limit of the second area ratio S2 to 20%, the first area ratio S1 is set no less than 10%.

Other Embodiments (1) In the second and fourth embodiment, the outer circumferential surface is roughened. However, since the projections having a constricted shape give a sufficient bond strength with the metal coating layer and the cylinder block, the outer circumferential surface does not necessarily have to be roughened.

(2) The projections of the second and fourth embodiment meet all the following conditions (a) to (d):

(a) the height of projections is 0.5 to 1.5 mm;

(b) the number of the projections is five to sixty per $cm^2$ on the outer circumferential surface;

(c) the first area ratio S1 of a region that is encircled by a contour line of a height of 0.4 mm is no less than 10% in a contour diagram of the projections, the diagram being obtained through measurement of the outer circumferential surface along the height of the projections with a three-dimensional laser measuring device; and (d) the second area ratio S2 of a region that is encircled by a contour line of a height of 0.2 mm is no more than 55% in a contour diagram of the projections, the diagram being obtained through measurement of the outer circumferential surface along the height of the projections with a three-dimensional laser measuring device.

Alternatively, the projections of the second and fourth embodiment may meet all the following conditions (a) to (d'):

(a) the height of projections is 0.5 to 1.5;

(b) the number of the projections is five to sixty per $cm^2$ on the outer circumferential surface;

(c') the ratio S1 of the area of a region that is encircled by a contour line of a height of 0.4 mm is 10 to 50% in a contour diagram of the projections, the diagram being obtained through measurement of the outer circumferential surface along the height of the projections with a three-dimensional laser measuring device; and (d') the ratio S2 of the area of a region that is encircled by a contour line of a height of 0.2 mm is 20 to 55% in a contour diagram of the projections, the diagram being obtained through measurement of the outer circumferential surface along the height of the projections with a three-dimensional laser measuring device.

Further, the projections of the second and fourth embodiments may meet at least one of the following conditions (a) and (b):

(a) the height of projections is 0.5 to 1.5 mm;

(b) the number of the projections is five to sixty per $cm^2$ on the outer circumferential surface;

In this case, a sufficient bond strength between the cylinder liner and the cylinder block is produced, and the adhesion is improved.

Projections may be adopted which meet conditions (c) and (d), and at least one of conditions (a) and (b), or conditions (c') and (d'), and at least one of conditions (a) and (b).

In this case, a sufficient bond strength between the cylinder liner and the cylinder block is produced, and the adhesion is improved.

(3) The projections 17 may be formed such that the regions R4 each surrounded by a contour line h4 in the contour diagrams shown in FIGS. 11 and 12 are independent from each other (that is, the projections 17 may be independent from each other at a position of a measurement height of 0.4 mm). This configuration further increases the bond strength between the cylinder block and the cylinder liner.

Further, if, at a measurement height of 0.4 mm, the area of each projection 17 is set to 0.2 $mm^2$ to 3.0 $mm^2$, breakage and reduction in bond strength of the projections 17 are suppressed during the production process.

The invention claimed is:

1. A component for insert casting having an outer circumferential surface that is enveloped in a casting metal through insert casting, wherein a metal coating layer is formed on the outer circumferential surface through a cold spraying method, wherein the outer circumferential surface of the component has a plurality of projections that each have a constricted shape and are covered by the metal coating layer, wherein the projections are formed to meet at least one of the following conditions (a) and (b):

(a) the height of projections is 0.5 to 1.5 mm; and (b) the number of the projections is five to sixty per $cm^2$ on the outer circumferential surface.

2. The component for insert casting according to claim 1, wherein the metal coating layer is formed of a metal material having a high thermal conductivity.

3. The component for insert casting according to claim 2, wherein the metal material is any one of aluminum, an aluminum alloy, copper, and a copper alloy.

4. The component for insert casting according to claim 1, wherein the metal coating layer is formed of a metal material having a melting point lower than that of the casting metal.

5. The component for insert casting according to claim 4, wherein the metal material is any one of zinc, a zinc alloy, tin, a tin alloy, lead, a lead alloy, antimony, and an antimony alloy.

6. The component for insert casting according to claim 1, wherein the projections are formed to meet the following conditions (c) and (d):

(c) in a contour diagram of the outer circumferential surface of the cylinder liner body obtained by a three-dimensional laser measuring device, the ratio of the total area of regions each surrounded by a contour line of a height of 0.4 mm to the area of the entire contour diagram is equal to or more than 10%; and (d) the ratio of the total area of regions each surrounded by a contour line of a height of 0.2 mm to the area of the entire contour diagram is equal to or less than 55%.

7. The component for insert casting according to claim 1, wherein the projections are formed to meet the following conditions (c') and (d'):

(c') in a contour diagram of the outer circumferential surface of the cylinder liner body obtained by a three-dimensional laser measuring device, the ratio of the total area of regions each surrounded by a contour line of a height of 0.4 mm to the area of the entire contour diagram is 10 to 50%; and (d') the ratio of the total area of regions each surrounded by a contour line of a height of 0.2 mm to the area of the entire contour diagram is 20 to 55%.

8. The component for insert casting according to claim 1, wherein the projections are formed to meet all the following conditions (e) and (f)

(e) in a contour diagram of the outer circumferential surface of the cylinder liner body obtained by a three-dimensional laser measuring device, regions each surrounded by a contour line of a height of 0.4 mm are independent from each other; and (f) the total area of regions each surrounded by a contour line of a height of 0.4 mm is 0.2 $mm^2$ to 3.0 $mm^2$.

9. A cylinder liner bonded to a cylinder block of an internal combustion engine, the cylinder liner comprising:

a cylinder liner body having an outer circumferential surface that is enveloped, through insert casting, in a casting metal for forming the cylinder block; and a metal coating layer that is formed on the outer circumferential surface through a cold spraying method, wherein the outer circumferential surface of the cylinder liner has a plurality of projections that each have a constricted shape and are covered by the metal coating layer, wherein the projections are formed to meet at least one of the following conditions (a) and (b):

(a) the height of projections is 0.5 to 1.5 mm; and (b) the number of the projections is five to sixty per $cm^2$ on the outer circumferential surface.

10. The cylinder liner according to claim 9, wherein the projections are formed to meet the following conditions (c) and (d):

(c) in a contour diagram of the outer circumferential surface of the cylinder liner body obtained by a three-dimensional laser measuring device, the ratio of the total area of regions each surrounded by a contour line of a height of 0.4 mm to the area of the entire contour diagram is equal to or more than 10%; and (d) the ratio of the total area of regions each surrounded by a contour line of a height of 0.2 mm to the area of the entire contour diagram is equal to or less than 55%.

11. The cylinder liner according to claim 9, wherein the projections are formed to meet the following conditions (c') and (d'):

(c') in a contour diagram of the outer circumferential surface of the cylinder liner body obtained by a three-dimensional laser measuring device, the ratio of the total area of regions each surrounded by a contour line of a height of 0.4 mm to the area of the entire contour diagram is 10 to 50%; and (d') the ratio of the total area of regions each surrounded by a contour line of a height of 0.2 mm to the area of the entire contour diagram is 20 to 55%.

12. The cylinder liner according to claim 9, wherein the projections are formed to meet all the following conditions (e) and (f):

(e) in a contour diagram of the outer circumferential surface of the cylinder liner body obtained by a three-dimensional laser measuring device, regions each surrounded by a contour line of a height of 0.4 mm are independent from each other; and (f) the total area of regions each surrounded by a contour line of a height of 0.4 mm is 0.2 $mm^2$ to 3.0 $mm^2$.

13. A cylinder block of an internal combustion engine, the cylinder block formed by casting a metal, wherein a cylinder liner is enveloped in the metal through insert casting so that the cylinder liner is bonded to the cylinder block, an outer circumferential surface of the cylinder liner, which is bonded to the cylinder block, has a metal coating layer formed through a cold spraying method, wherein the outer circumferential surface of the cylinder liner has a plurality of projections that each have a constricted shape and are covered by the metal coating layer, wherein the projections are formed to meet at least one of the following conditions (a) and (b):

(a) the height of projections is 0.5 to 1.5 mm; and (b) the number of the projections is five to sixty per $cm^2$ on the outer circumferential surface.

14. The cylinder block according to claim 13, wherein the metal is aluminum or an aluminum alloy.

15. A method for manufacturing a cylinder liner that is, through insert casting, enveloped in a block material forming a cylinder block of an internal combustion engine, the method comprising:

preparing a cylindrical cylinder liner body; and forming a metal coating layer on an outer circumferential surface of the cylinder liner body through a cold spraying method, wherein the outer circumferential surface of the cylinder liner has a plurality of projections that each have a constricted shape and are covered by the metal coating layer, wherein the projections are formed to meet at least one of the following conditions (a) and (b):

(a) the height of projections is 0.5 to 1.5 mm; and (b) the number of the projections is five to sixty per $cm^2$ on the outer circumferential surface.

16. The manufacturing method according to claim 15, wherein the forming of the metal coating layer includes forming, on the outer circumferential surface of the cylinder liner body, a metal coating layer made of a metal material having a high thermal conductivity.

17. The manufacturing method according to claim 16, wherein the forming of the metal coating layer includes forming, on the outer circumferential surface of the cylinder liner body, a metal coating layer made of a metal material that is any one of aluminum, an aluminum alloy, copper, and a copper alloy.

18. The manufacturing method according to claim 15, wherein the forming of the metal coating layer includes forming, on the outer circumferential surface of the cylinder liner body, a metal coating layer made of a metal material having a melting point lower than that of the block material.

19. The manufacturing method according to claim 18, wherein the forming of the metal coating layer includes forming, on the outer circumferential surface of the cylinder liner body, a metal coating layer made of a metal material that is any one of zinc, a zinc alloy, tin, a tin alloy, lead, a lead alloy, antimony, and an antimony alloy.

* * * * *